United States Patent [19]

Moruzzi et al.

[11] 4,185,450

[45] Jan. 29, 1980

[54] PROCESS FOR THE TEXTURIZATION OF POLYCAPRONAMIDE FIBRES AND TEXTURIZED POLYCAPRONAMIDE FIBRES OBTAINED ACCORDING TO THE PROCESS

[75] Inventors: Pietro Moruzzi, Milan; Francesco Cadau, Seveso Milan, both of Italy

[73] Assignee: Snia Viscosa Societa' Nazionale Industria Applicazioni Viscosa S.p.A., Milan, Italy

[21] Appl. No.: 863,310

[22] Filed: Dec. 22, 1977

[30] Foreign Application Priority Data

Dec. 24, 1976 [IT] Italy ..... 30851 A/76

[51] Int. Cl.[2] ..... D02G 1/02

[52] U.S. Cl. ..... 57/247; 57/280; 57/288

[58] Field of Search ..... 57/157 TS, 157 S, 284, 57/287, 288, 279, 280

[56] References Cited

U.S. PATENT DOCUMENTS

| | | | |
|---|---|---|---|
| 3,535,866 | 10/1970 | Tsuruta et al. | 57/157 TS X |
| 3,638,410 | 2/1972 | Schezberg et al. | 57/157 TS X |
| 3,733,801 | 5/1973 | Jones | 57/157 TS |
| 3,842,578 | 10/1974 | Schippers | 57/157 TS X |
| 3,903,682 | 9/1975 | Crouzet et al. | 57/157 TS X |
| 3,971,201 | 7/1976 | Hartig | 57/157 TS X |

*Primary Examiner*—John Petrakes

*Attorney, Agent, or Firm*—Burgess, Ryan and Wayne

[57] ABSTRACT

There is described a process for making a texturized polycapronamide yarn wherein the yarn is spun at a spinning speed below 1500 metres per minute and then subjected to a drawing and texturizing treatment including drawing, false twisting and heat treatment operations. The process is noted in that no more than two of said operations are carried out concurrently at least when the processing of the yarn is being started and the heat treatment is carried out under temperature conditions such as to set the false twist. There are also described the polycapronamide fibres and yarns texturized and manufactured by carrying out the process.

13 Claims, 5 Drawing Figures

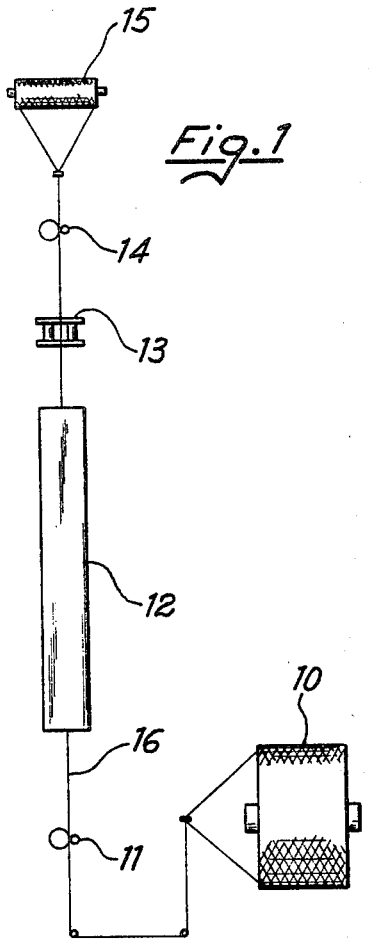
Fig. 1
Fig. 2
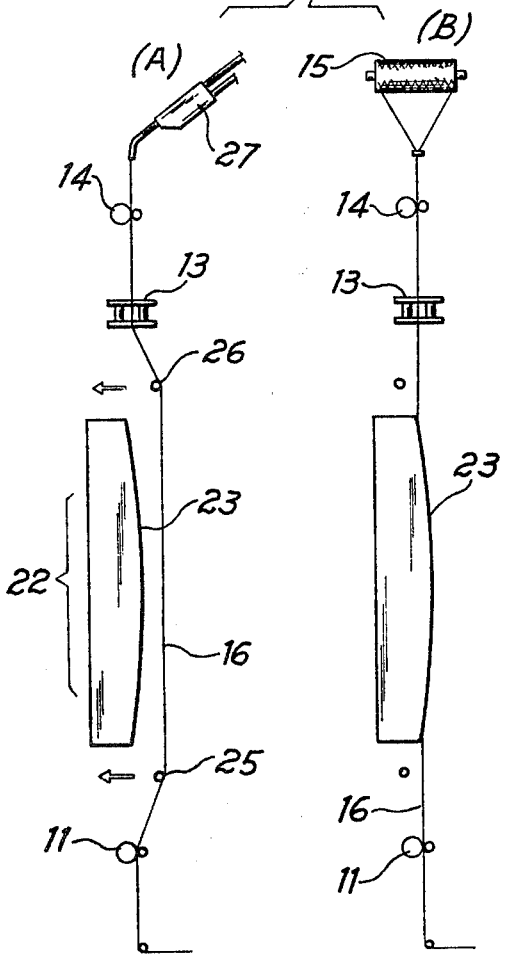

(A)
(B)
14
13
27
12
11
16
15
43
42
41
10

53
52
51

PROCESS FOR THE TEXTURIZATION OF POLYCAPRONAMIDE FIBRES AND TEXTURIZED POLYCAPRONAMIDE FIBRES OBTAINED ACCORDING TO THE PROCESS

BACKGROUND OF THE INVENTION (1) The Field of the Invention

The present invention is directed to a process for the texturization of polycapronamide (nylon 6) fibres and to the texturized polycapronamide fibres thus obtained.

(2) The Prior Art

It has been theoretically known for a long time that it is possible to obtain texturized yarns by false twisting and setting synthetic yarns, either wholly preoriented by drawing or preoriented, to a more or less marked degree but not completely, by high speed spinning or partial drawing, or, further, completely unoriented, viz. as they are spun by the normal speed conventional processes.

The process involving complete drawing and subsequent texturization, by false twisting, is actually the only one, industrially applied to polyamide fibres. The process involving partial preorientation by high speed spinning and subsequent texturization by false twisting with concurrent or sequential completion of the drawing is industrially applied to polyester fibres. The texturization by false twisting starting from a completely unoriented yarn, spun at normal speed,—normal speed meaning, in the case of polycapronamide yarns to which this invention refers, speeds not greater than 1500 and preferably not greater than 1200 meters per minute—has not found application in the industry. The texturization of unoriented yarn has hitherto been believed to be in practicable for a series of reasons. It was not believed possible to carry out the operations regularly, by means of normal industrial apparatus without causing an excessive number of yarn breakages. It was also believed that the quality of the texturized yarn thus obtained would be inferior.

In this connection, the state of the art is represented, as far as the Applicant is aware, by U.S. Pat. No. 3,601,972 in the name of Rogers, wherein the texturization of polyamide yarns is described and discussed. Said patent, precisely, underlines the impracticability of a texturization starting from unoriented yarn, both with respect to the process and to the quality of the yarn, and suggests partially to predraw the yarn and then to texturize it using a ratio between the draw ratio in the texturization stage and the draw ratio in the predrawing stage which preferably varies from 0.3 to 0.8, viz. starting from a yarn having a rather marked degree of orientation. The Rogers patent describes only nylon 66, viz. polyadipate of hexamethylenediamide yarns, and the maximum draw ratio exemplified is 1:3, viz. a ratio lower than is normal for nylon 66.

An analysis of the art relative to the drawing-texturization processes, which generally declares the impracticability of the texturization by false twisting and setting of completely undrawn yarns, is contained in U.S. Pat. No. 3,771,307 as well. The patent describes a process analogous to the Rogers process applied to polyester yarns.

The fact that processes of the type described by the Rogers patent have not been practically applied to polyamides, can be explained by technical considerations. Polyester yarn is hot drawn and it is therefore logical to combine this operation with other operations which are done such as false twist texturization. Such a combination is neither logical nor desirable in the case of the polyamides which are cold drawn.

On the other hand, the drawbacks recited by Rogers with regard to the texturization of non-preoriented nylon, are connected to a substantial extent with the plasticity of nylon at the false twist setting temperatures. If it is taken into account that Rogers has found said drawbacks when using nylon 66, the persons skilled in the art could not but believe that the results would be even worse with nylon 6, the melting point of which is considerably lower than that of nylon 66.

Summing up, the state of the art indicated that the texturization by false twisting and setting of unoriented synthetic fibre was not applicable industrially to polyamide fibres because of the serious operational difficulties and of the low quality of the product that would theoretically be obtained. The prior art suggested that said drawbacks, which mitigated against use of the process for nylon 66, should be even more serious for nylon 6 (polycapronamide, normally obtained by polymerization of caprolactam).

SUMMARY OF THE INVENTION

The Applicant has surprisingly found, that contrary to prior art teachings it is possible, by suitably operating in certain ways, to carry out the texturization by false twisting and setting of polycapronamide fibres, which are substantially unoriented, viz. spun with wind-up speeds in the order hereinbefore specified. In addition said process leads to a product having characteristics that are surprisingly far superior to those obtainable by the traditional process, of texturizing a previously completely drawn yarn.

The superior qualities of the texturized product obtained by the process of the present invention, which constitute the most surprising element of the new technical result of the invention, and characterize the product itself as an intrinsically new product, are evident to a person skilled in the art who examines and manipulates the texturized yarn the knitted products obtained therefrom.

It is possible to determine the superior elasticity of the yarn according to the invention by quantitative tests carried out preferably on knitted products made therefrom.

One such test will be described with reference to stockings made from 20 denier, 6 filament yarn, which represents a most commonly used count for such goods.

A stocking is made on a 4 feed circular knitting machine having a diameter of $3\frac{3}{4}''$ and 400 needles, or optionally a diameter of 4" and 434 needles. The knit is a plain knit. The stocking is dyed but not set. The perimeter of the stocking opening or thigh, in fully stretched condition, is 37 cm. The stocking is placed with its opening over two parallel, horizontal rods, one of which may be fixed while the other is slidable on a vertical support and is loaded with a variable weight. The second rod is so loaded as to fully stretch out the stocking opening to its maximum perimeter without impairing its elastic recovery: this is generally achieved with a 4 Kg. weight. The load is then successively decreased whereby the stocking contracts. The load which allows the stocking opening to contract to half its aforesaid maximum perimeter is assumed as the index of elastic recovery of the yarn.

Two identical nylon 6 yarns having 20/6 count are texturized, the first by the conventional process, viz. completely drawing the yarns before texturizing, and the other by the process according to the invention, specifically according to the embodiment of FIG. 1. The above described test is carried out on both. The first, conventional yarn has an elastic recovery index below 200 grams, while the second has an index above 210 grams. The same relationship exists if the count is changed or if the intrinsic quality of the yarn before texturizing changes for any reason, as long as the same starting yarn is used for texturizing and knitting stockings from the texturized yarn, once by firstly drawing it completely and once by carrying out the process of the invention.

Since the elastic recovery index tends to be proportional to the count, it may be said that the yarn according to the invention has an index of at least 10.5 gr/denier.

Increased elasticity however is not the only advantage or superiority of the yarn according to the invention.

The knitted products made from said yarns have a hand, a softness, a pleasant feel when touched and when used, which are far superior to those of the yarns obtained by traditional methods. However—and this confirms the new and surprising character of the invention—it has not been possible so far to translate these properties into figures, viz. to find laboratory tests capable of characterizing them and of furnishing indices to compare said yarns with different ones or the fabrics obtained therefrom with fabrics obtained from other yarns. This indicates that in these respects the superiority of the product according to the invention is due to some factor unknown in the art so far, or at least on which the attention of the persons skilled in the art has not focussed, as confirmed by the fact that it is not evidenced by the tests ordinarily used in the art to evaluate and classify the texturized yarns obtained by the previously known methods.

The process according to the invention, comprises the stages of starting from a polycapronamide yarn, spun at a speed below 1500 meters per minute and preferably not higher than 1200 meters per minute, and still more preferably spun at speeds between 600 and 1200 meters per minute, and therefore definable as substantially unoriented, subjecting said yarn to a drawing and texturizing process, predisposed to effect the drawing to the desired degree. The drawing and texturizing comprising the preferably concurrent but optionally sequential operations of drawing, false twisting and heat treatment, wherein not more than two of said operations are carried out concurrently at least when the processing of the yarn is started. The heat treatment setting the false twist and being carried out under the temperature conditions hereinafter defined.

Preferably when the processing is started, the yarn is drawn and false twisted but is not subjected to the heat treatment, until after a period of time long enough for the setting operation to occur when the yarn has been completely drawn. In practice, when the texturized yarn wind-up speed varies from 150 to 300 m/min., said period of time varies from 2 to 4 seconds, and if the speeds are different, the said times may vary in direct ratio to said speed.

If the false twist is set by contact of the yarn with a heated body (commonly called heated plate and having a convex configuration) the processing is started by drawing and false twisting the yarn but keeping the same spaced from the heated plate for the aforesaid periods of time and thereafter bringing the yarn into contact with the plate. If the false twist setting means is different, and is e.g. constituted by an oven, through which the yarn travels and in which it is heated by radiation and/or by convection without contact with solid bodies, one may use an openable oven which is open at the beginning of the operation and is closed to circumscribe the yarn path only after aforesaid periods of time have passed. This method produces a certain amount of initial scrap, but this is a common phenomenon in textile operations and is so limited as to be practically irrelevant. Alternatively, the yarn may be subjected at once to the heat treatment and set into motion without carrying out the drawing and preferably the false twisting as well, which operations are begun only subsequently and when the yarn is already in motion.

The draw ratios employed in the process according to the invention are not substantially different from those normally employed in the art, and therefore in the case of nylon 6 are generally between about 2.5 and 3.6, preferably between 2.8 and 3.3.

Although it is preferable to draw and texturize concurrently, one may, as has been said, draw and texturize sequentially, in which case the drawing can be done in the cold.

It is also possible, and it falls within the scope of the invention, to effect any known variation in the texturization operations, and thus a second heat setting may be carried out to modify the crimp of the yarn and to obtain bulked yarns having the desired mechanical properties.

Such a possibility must be considered as being implicit and understood when the word "texturization" is used without any further precision.

The invention will now be more particularly described with reference to the attached drawings which schematically illustrate apparatuses for carrying the invention into practice, wherein:

THE SEVERAL VIEWS OF THE DRAWINGS

FIG. 1 is a general diagram of an apparatus for carrying out an embodiment of the invention, shown in its regular operation;

FIG. 2 is a schematic illustration of a device which may be employed for starting the operation when a heating by contact apparatus is used;

Figures 3, 4, 5:
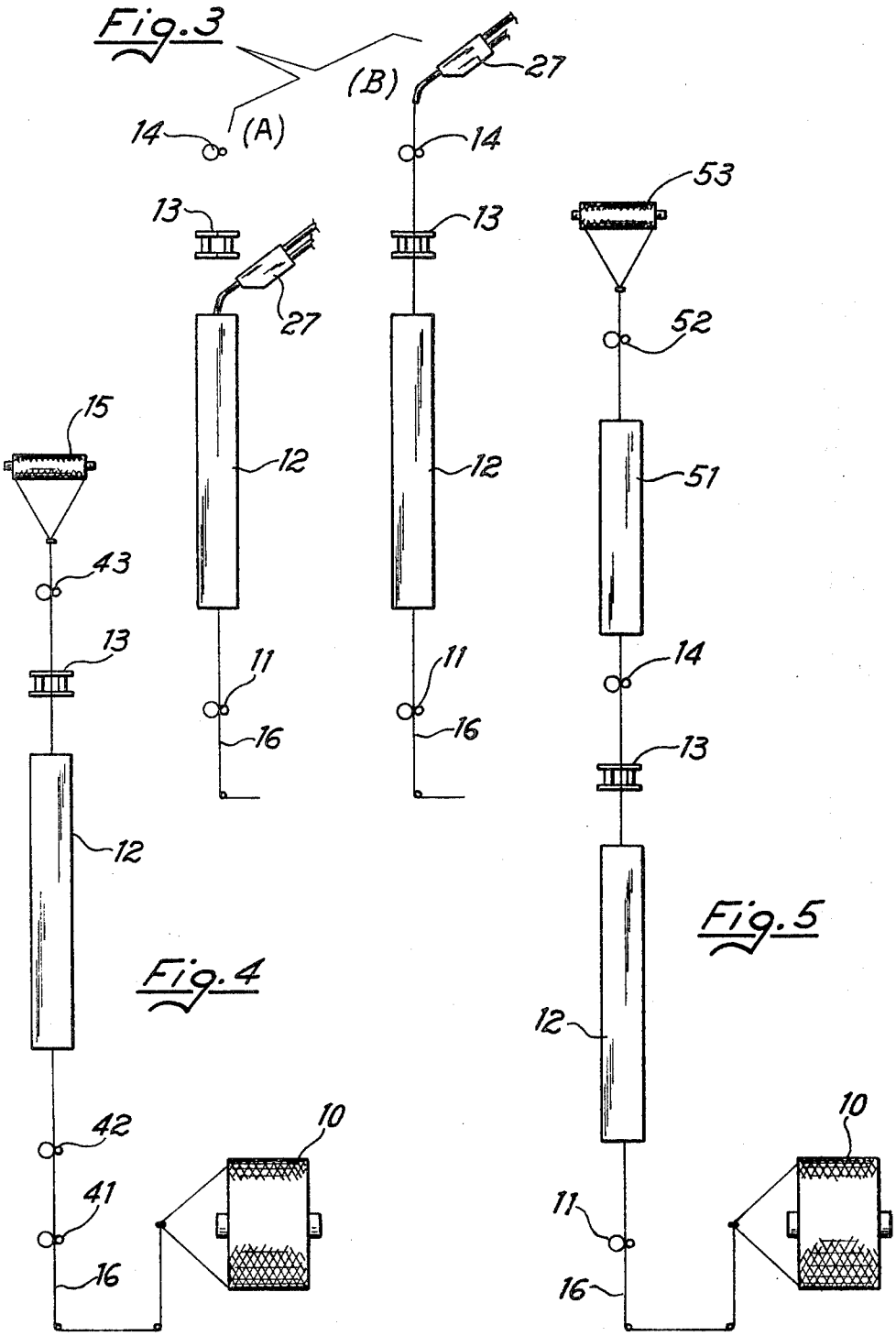

FIG. 3 illustrated a device for starting the operation when the apparatus of FIG. 1 is used;

FIG. 4 is analogous to FIG. 1 but represents an apparatus for carrying out a variant of the process and precisely for effecting the drawing and the false twisting not concurrently but sequentially; and FIG. 5 illustrates a variant constituted by the fact that a second heat setting is carried out by modifying the diagram of FIG. 1 in a manner known per se.

DETAILED DESCRIPTION OF THE PREFERRED EMBODIMENTS

In FIG. 1, numeral 10 indicated a bobbin or at any rate a winding from which the starting polycapronamide yarn 16 is drawn, which yarn has been spun at the speeds previously indicated and therefore is substantially unoriented. Numeral 11 designates the roller group which draws the yarn, which rollers constitute the feed rollers of the texturization group and concurrently the slow rollers with respect to the drawing operation. From rollers 11 the yarn passes to the texturization setting device 12, herein schematically shown as a cylindrical oven but which may have any desired structure, and from this latter, to the false twist device 13 which may have any suitable structure and will be generally called "spindle". The yarn is drawn by draw rollers 14, which constitute the fast rollers group with respect to the drawing operation, the peripheral speed of which, with respect to that of rollers 11, is determined by the desired draw ratio, in a manner known per se, and passes therefrom to a collecting apparatus to form a bobbin indicated at 15.

An apparatus corresponding to that of FIG. 1 is shown in two positions (A) and (B) in FIG. 2, wherein however the setting device 22 is a so-called hot plate, viz. a body which is provided with a heated, slightly convex surface indicated at 23. The parts common to FIG. 1 are designated by the same numerals used in said FIG. 1, and the bobbin 10 has been omitted to simplify the drawing. The apparatus further comprises two mobile yarn guides 25–26. In position (A) to yarn guides 25–26 are so located as to keep the yarn 16 away from the surface 23. Under this condition, when the operation is started, the yarn is engaged by any suitable drawing device, e.g. is sucked by a suction device 27, and is then started onto the bobbin 15. After the prescribed period of time as hereinbefore set forth, the apparatus passes to the position (B), viz. the yarn guides 25–26 become displaced in such a manner as to cease to engage the yarn 16 and to allow it to contact the surface 23, as illustrated at 2 (B). The motion of the yarn guides may be brought about in any way, e.g. by mounting them on a plate which may be rotated, or otherwise.

In the variant of FIG. 3, since a closed oven of the type of that of FIG. 1 is used, instead of starting the drawing and false twisting immediately and starting the heating of the yarn only after a certain time interval, as in the case of FIG. 2, the heating is begun immediately by introducing the end of the yarn into the inlet of oven 12, and setting the yarn in motion through the oven but without drawing and without twist, by means of any suitable pick-up device, e.g. a suction device such as that of FIG. 2 and which is therefore designated by the same numeral 27, as illustrated at (A), which sucks the yarn from the oven outlet opening; subsequently the yarn is engaged with the false twist device 13 and with the draw rollers 14, as illustrated at (B). In this manner too the operation is started up without damage to the yarn.

In FIG. 4 an apparatus is schematically illustrated for carrying out a variant of the process wherein drawing and false twisting occur sequentially. The starting bobbin is indicated at 10 and the bobbin on which the texturized yarn is collected is once again designated by the numeral 15. The setting device is herein illustrated as an oven, as in FIG. 1, and has the same numeral 12, and likewise the false twist spindle is schematically indicated at 13. Herein however the yarn is initially drawn from the bobbin 10 by means of a slow roller group 41 and passes successively, without heating, through a roller group 42 at such a speed that the desired drawing is produced between 41 and 42. Subsequently the yarn is subjected to false twisting and setting and is drawn by rollers 43 the speed of which differs from that of rollers 42 as much as is necessary to produce the desired texturization tension.

FIG. 5 illustrated a variant of the application of the process according to the invention, wherein the yarn initially undergoes all the treatments described above (in particular, assuming that a setting oven is used herein as well, the various parts have been identified by the numerals used in FIG. 1), but once the yarn has been drawn by the high speed rollers 14, it is not wound up but passes through a second setting oven 51 and is drawn by rollers 52 and is finally wound up on a bobbin 53. The purpose of this second heat setting, per se known in the art, is to impart to the yarn the desired bulk while reducing its elasticity, and to this end, the temperature of the setting device 51 is usually close to that of the device 12 but the speed of the rollers 52 is significantly lower than that of rollers 14.

Some preferred quantitative factors of the process will now be specified.

The overall draw ratio, calculated as the ratio between the peripheral speeds of the rollers 14 and of the rollers 11, in FIGS. 1 and 5, and of the rollers 41 and 42 in FIG. 4, is comprised between 2.5 and 3.6, preferably between 2.8 and 3.3.

The number of revolutions of the false twist device (spindle) is such as to impart a number of twists per meter of yarn, in relation to the travelling speed of the yarn itself (which is generally comprised between 140 and 300 m/min.), comprised between 2000 and 5000, and preferably between 2500 and 4100.

The texturization temperature should theoretically be determined through a direct measure on the yarn but this is a very difficult and nearly impossible operation and therefore said temperature is defined in the present description, as is customary, by means of the temperature which is imparted to the heating organ.

With yarn wind-up speeds, viz. peripheral speeds of the rollers 15, in FIG. 1, and analogously for the other variants, comprised between 140 and 300 m/min., when a contact heating plate is employed which the yarn contacts over a length variable from 1 to 1.5 meters, the temperature of the hot plate is comprised between 150° and 200° C. In practice the most common conditions are: yarn collecting speed on the rollers 15, about 170 m/min.; hot plate contact length, about 1.2 m; hot plate temperature, about 170° C.

When an oven is used through which the yarn travels without contacting its walls, the temperature of the air inside the oven, for yarn speed and heating zone length conditions analogous to those hereinbefore set forth with reference to a hot plate, varies between 150° and 200° C. and is more commonly about 170° C.

In the case illustrated in FIG. 4, in which the drawing and the false twisting occur sequentially, the quantitative data set forth above remain substantially unchanged, taking into account that the draw ratio between the slow cold rollers 41 and the fast cold rollers 42 (viz. the ratio between the peripheral speed of rollers 42 and that of rollers 41) is comprised between 2.5 and 3.6, preferably between 2.8 and 3.3, while the difference of the peripheral speeds between the fast cold rollers and the take-up rollers 43 is only that required to permit the contraction of the yarn due to the texturization, and therefore said take-up rollers have a peripheral speed that is less than that of the fast cold rollers by an amount in the order of 7–12%.

When a second setting operation is carried out, as in FIG. 5, the peripheral speed of the take-up rollers 52 is 14–18% lower than that of the rollers 14 and the air temperature in the oven 51 or the temperature of the hot plate which may be used in place thereof (which will called "setting" temperature without further precision, thus to distinguish it from the aforesaid "texturization" temperature) is 150°–200° C. for the yarn linear speeds set forth with reference to FIG. 1. All the numerical data set forth hereinbefore are preferred but not binding.

For a further illustration of the invention, the numerical values of the process variables in some concrete embodiments of the invention are tabulated in the following Table. The yarn is polycapronamide (nylon 6). Five different counts, one for each example, are exemplified. The variables specified are: the feed speed, viz. the speed of the slow rollers 11 or 41; the number of twists per meter imparted by any false twist device (e.g. a friction or magnetic spindle); the draw ratio; the texturization temperature, viz. the air temperature in the closed oven 12 (for examples 3, 4 and 5) or the surface temperature of the hot plate 22 (for examples 1 and 2); the setting temperature, viz. the temperature of the oven or the hot plate 51 of FIG. 5, for example 5 only, since the second heat treatment has not been effected in the other examples; and finally, the crimp rigidity of the texturized yarn, measured by the HATRA method.

Obviously the invention could be carried into practice in ways different from those which have been illustrated by way of examples.

EXAMPLES 1–5

| Example No. | 1 | 2 | 3 | 4 | 5 |
|---|---|---|---|---|---|
| Count (dtex)/number of filaments | 22/6 | 44/10 | 78/18 | 67/18 | 76/18 |
| Feed speed (m/min.) | 175 | 175 | 280 | 118 | 118 |
| Number of twists/meter | 4100 | 4000 | 3200 | 3500 | 3500 |
| Draw ratio | 2.90 | 3.00 | 2.80 | 3.10 | 3.10 |
| Texturization temperature (°C.) | 175 | 170 | 160 | 175 | 175 |
| Setting temperature (°C.) | — | — | — | — | 180 |
| Crimp rigidity | 56 | 40 | 25 | 28 | 10 |

We claim:

1. In a process for making texturized polycapronamide yarn from a substantially unoriented polycapronamide yarn comprising the steps of drawing, sufficient to set the false twist, the improvement comprising starting up said process by conducting only one of the following steps for a period of time equivalent to the time sufficient for setting to occur when the yarn is completely drawn:

(A) Concurrently false twisting and drawing at the conditions utilized during table operations by feeding the yarn at a positive high speed, said false twisting being carried out in a zone between the point at which the yarn is fed and the point at which it is taken up; and (B) Concurrently drawing at the draw ratio utilized during stable operation, by feeding the yarn at a positive lower speed and taking up said yarn at a positive high speed, setting said yarn by heating in a zone maintained at the temperature utilized during stable operation, between the point at which the yarn is fed and the point at which it is taken up;

followed by beginning the remaining steps of heating or false twisting, respectively, while continuing the steps already begun.

2. Process according to claim 1, wherein said drawing and false twisting steps are carried out concurrently.

3. Process according to claim 2, wherein said heating is carried out at a temperature of about 170° C.

4. Process according to claim 1, characterized in that the drawing and texturization operations are carried out concurrently.

5. Process according to claim 1, wherein the draw ratio is from 2.5 to 3.6.

6. Process according to claim 5, wherein the draw ratio is from 2.8 to 3.3.

7. Process according to claim 1, wherein the false twist imparted is between 2000 and 5000 turns per meter of the yarn.

8. Process according to claim 7, wherein the false twist imparted is between 2500 and 5000 turns per meter of the yarn.

9. Polycapronamide texturized yarn, made by the process of claim 1.

10. Polycapronamide texturized yarn according to claim 9, which possesses superior hand and softness and has an elastic recovery index of at least 10.5 grams per denier.

11. Process according to claim 1, wherein said substantially unoriented polycapronamide yarn is made by spinning at a speed below 1500 m/min.

12. Process according to claim 11, wherein said substantially unoriented polycapronamide yarn is made by spinning at a speed below 1200 m/min.

13. Process according to claim 12, wherein said substantially unoriented polycapronamide yarn is made by spinning at a speed between 600 and 1200 m/min.

* * * * *